US010023353B2

(12) United States Patent
Chan

(10) Patent No.: US 10,023,353 B2
(45) Date of Patent: Jul. 17, 2018

(54) SEALING STRUCTURE FOR PLASTIC PACKING BOX

(71) Applicant: Lin-Lang Chan, Taichung (TW)

(72) Inventor: Lin-Lang Chan, Taichung (TW)

( * ) Notice: Subject to any disclaimer, the term of this patent is extended or adjusted under 35 U.S.C. 154(b) by 0 days.

(21) Appl. No.: 15/253,895

(22) Filed: Sep. 1, 2016

(65) Prior Publication Data

US 2018/0057203 A1 Mar. 1, 2018

(51) Int. Cl.
*B65D 6/34* (2006.01)
*B65D 6/00* (2006.01)

(52) U.S. Cl.
CPC ..... *B65D 11/22* (2013.01); *B65D 11/10* (2013.01)

(58) Field of Classification Search
CPC ..... B65D 11/22; B65D 11/10; B65D 11/14; B65D 11/26
USPC ..... 229/125.39, 125.13, 122.22, 199; 220/639, 645
See application file for complete search history.

(56) References Cited

U.S. PATENT DOCUMENTS 5,050,763 A * 9/1991 Christensson ..... B65D 5/64 220/810
8,011,566 B2 * 9/2011 Robertson ..... B65D 43/165 220/833
9,630,741 B2 * 4/2017 McClaughry ..... B65D 43/169
2008/0099546 A1 * 5/2008 Cronin ..... B65D 5/6697 229/125.26
2015/0298856 A1 * 10/2015 Shiotani ..... B65D 21/0235 206/509

* cited by examiner

*Primary Examiner* — Christopher Demeree
(74) *Attorney, Agent, or Firm* — Leong C. Lei

(57) ABSTRACT

A sealing structure for a plastic packing box, comprising: a packing box body, made by bending a plastic plate; top and bottom openings; and cover plates, configured on sides of each opening and bended inward to stack together to seat the opening, wherein a premade mating frame is respectively engaged with sealing end faces of the outer cover plates configured on two opposite sides of the main body and bended to each other to form a sealing edge, the mating frames are a male-female pair stacked together to sealing the box, ensuring that two end faces is neat after box body sealing, the opposite inner edges of the two mating frames are respectively configured with male and female buckling elements allowed to be pressed together to engage with each other after the stacking, thereby achieving stable and safe buckling, while the cover plate are stacked together simply.

9 Claims, 5 Drawing Sheets

SEALING STRUCTURE FOR PLASTIC PACKING BOX

(a) TECHNICAL FIELD OF THE INVENTION

The present invention relates to a sealing structure for a plastic packing box, allowing cover plates adapted to seal the mouth of the box simply and conveniently after the filling of it with articles.

(b) DESCRIPTION OF THE PRIOR ART

Conventionally, the four bendable cover plates of a cardboard packing box or new moisture-proof plastic packing box configured respectively on the four sides of the mouth and bottom thereof are bended inward to form inner and outer layers to cover the box after it is filled with articles, achieving the complete covering of the top and bottom of the box. Thereafter, an adhesive tape is applied to the edges of the two bended outer cover plates opposite to each other to seal the box completely. However, such kind of adhesive tape sticking to seal a box may have no problem for cardboard boxes, but it is not ideal to use an adhesive tape to seal the mouth of a plastic box after it is filled with articles because the surface thereof is slippery and uneasy to be stuck, and the plate itself is hard and easy to be deformed. If a perfect sealing is needed, a highly sticky tape, hot sol or even nails must be used to seal the engagement rims of the bended cover plates after the box is filled with articles. If the sealing is still uneven, strapping is even used to carry out full box packing to achieve safe sealing, which not only increases sealing working hour and material cost but relies on relatively skilled personnel, resulting in the overall cost of package to be increased, being environmentally unfriendly, causing follow-up box opening and plate recycling classification process to be inconvenient.

SUMMARY OF THE INVENTION

The main object of the present invention is to provide a sealing structure for a plastic packing box, engaging mating having male and female buckling element with the sides of opposite plastic cover plates to form particular staking, buckling and sealing sides, and buckling the opposite cover plates together simply through the male, female buckling elements, thereby covering the top face of a box body neatly, and achieving both buckling and box sealing at the same time.

DETAILED DESCRIPTION OF THE PREFERRED EMBODIMENTS

Figure 1:
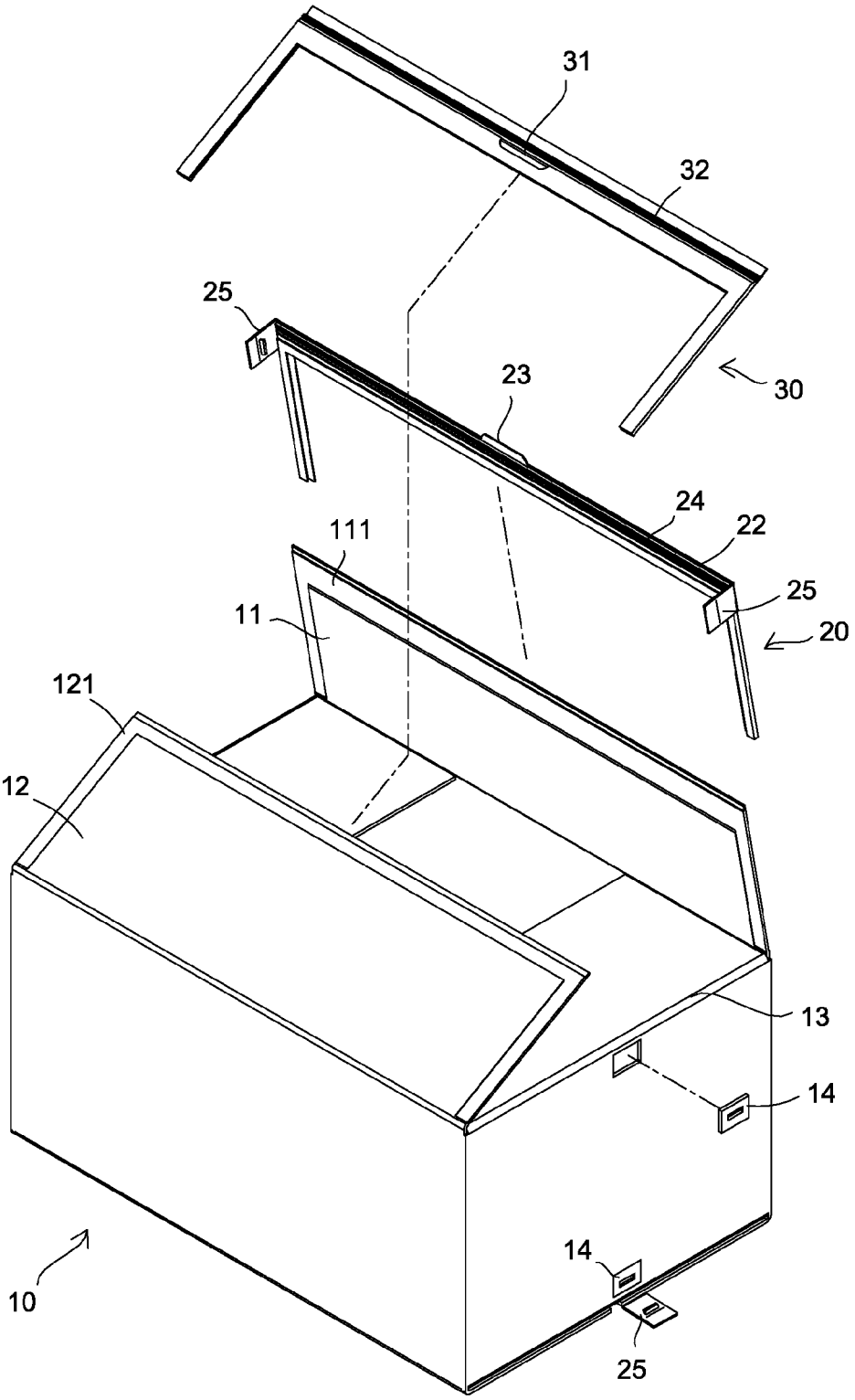
FIG. 1 is a perspective view of sealing side structures of a box body according to the present invention.
Figure 2:
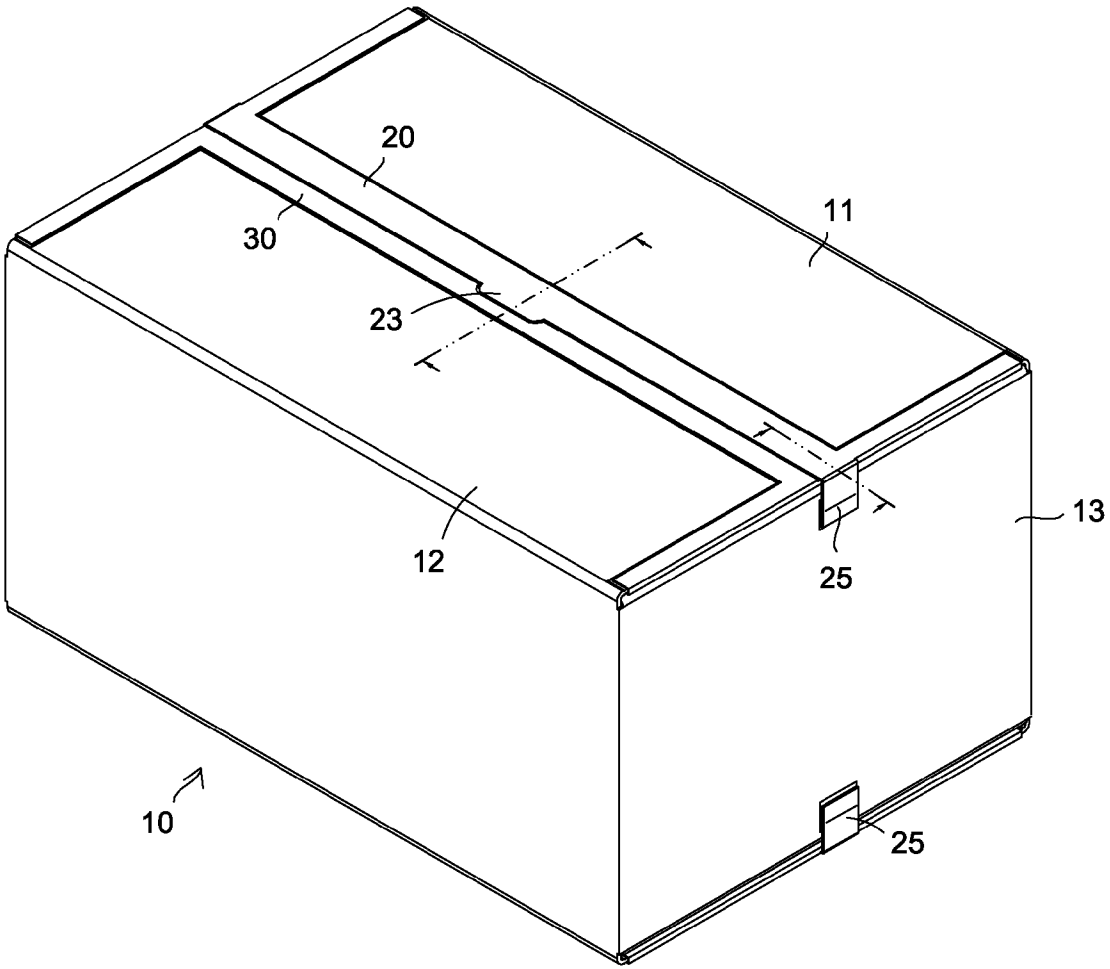
FIG. 2 is a perspective view of a sealed box body after packing according to the present invention.
Figure 3:
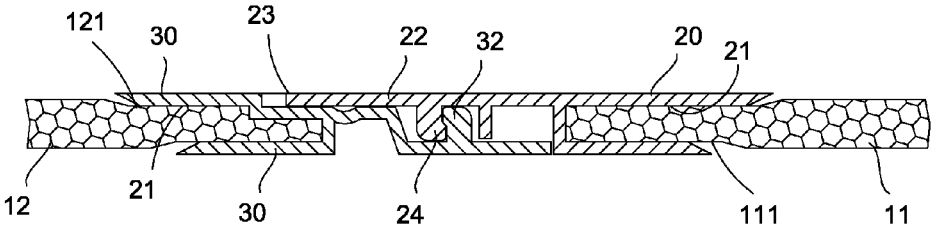
FIG. 3 is a cross-sectional view of a sealing and engagement structure of the box body of the present invention.
Figure 4:
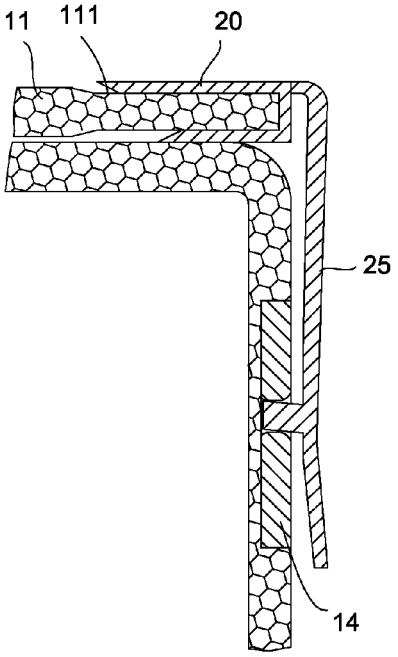
FIG. 4 is a cross-sectional view of a buckling auxiliary on the two sides of the box body according to the present invention.

A sealing structure for a plastic packing box according to the present invention mainly provides a sealing structure configured on the mouth of the box adapted to seal the box after the packing of the plastic box. Referring to FIGS. 1 to 4, the sealing structure includes a packing box body 10 formed by bending a hollow plastic plate, similar to the outlooks of general box bodies and commonly designed to be square or rectangular; the upper and lower sides thereof are respectively formed with an opening, two opposite sides of which are respectively configured with a bendable symmetrical cover plate 11, 12, the two cover plates 11, 12 being bended to engage with each other in an inner and outer order to seal the opening of the box body exactly. The four bendable cover plates on one end of the box body 10 must be bended first to seal the box to form a box bottom before packing for the filling of articles in the box safely. The present invention mainly allows the cover plates 11, 12 to seal the box at the same when they are bended oppositely to the upper or lower openings of the main body 10 to close the box.

Slightly concave mating faces 111, 121 are respectively configured on the engagement edges of the cover plates 11, 12 for the engagement of premade inverted U-shaped mating frames 20, 30 having a shape and size similarly to the ones of the sealing sides of the cover plate 11, 12, where the mating frames 20, 30 respectively have a groove 21 indented a proper depth similarly to the width of the mating face 111, 121, allowing the frames to be engaged with the edges of the cover plates 11,12, thereby forming a fixing frame edge for each cover plate. furthermore, the mating frames 20, 30 are respectively inserted with the edges of the cover plates 11, 12 to form sealing frame edges for engagement and stacking, thereby allowing the cover plates to be covered together to seal the box. Furthermore, the frame edge of the mating frame 30 engaged with one side of the cover plate 12 is indented slightly to form a stepped face for a stacking face to be flat after the cover plate 11 is covered on the frame edge of the mating frame 30. To ensure the engagements of the mating frames 20, 30 with the cover plates 11. 12 are stable, they can be bonded together simply by means of hot welding after the engagement because they are all made from plastics, resulting in the tight combination of the mating frame 20, 30 with the cover plates 11, 12 without doubt of falling off. Furthermore, the top surface 22 of the male mating frame 20 is extended outward like a cantilever, and the extension section close to the middle of the cover plate 11 is configured with a poking tab 23 having a proper width, allowing a unpacking force to be exerted stably; the poking table is extended unto a proper distance from the edge of the mating frame 30 at another side of the sealing line after the covering. In addition, a long striped-typed male buckling element 24 is configured on the middle of the inner side of an extended top plate face, and a plurality of male buckling elements 24 may also be configured separately according to the length of the plate face, thereby labor-saving and squeeze elastic auxiliary upon buckling. Furthermore, the female mating frame 30 at another side of the sealing line is extended with a length in a way of matching the top plate face 22 of the male mating frame 20, and a concave stepped plate face 31 is configured on the frame body top face for the accommodation of the extended top plate face 22, with a female buckling element 32 corresponding to the male buckling element 24 being configured on the stepped plate face 31, capable of engagement thereof with the male buckling element 24. In addition, concave and convex portions for auxiliary positioning may respectively configured on the sides of the buckling elements, but the configurations are not necessary such that they are not shown in the figures; they are convenient for the engagement and positioning of the two mating frames 20, 30. Furthermore, a bendable buckling sheet 25 flush with one side of the box body and extended from the two ends of the mating frame 20 can be bended directly to engaged with a corresponding groove buckling element 14 respectively configured on two opposite side plates 13 of the box body, thereby to buckle the two side ends tightly and ensure the top face of the box can be sealed neatly and the sealing can be safe and stable.

Figure 5:
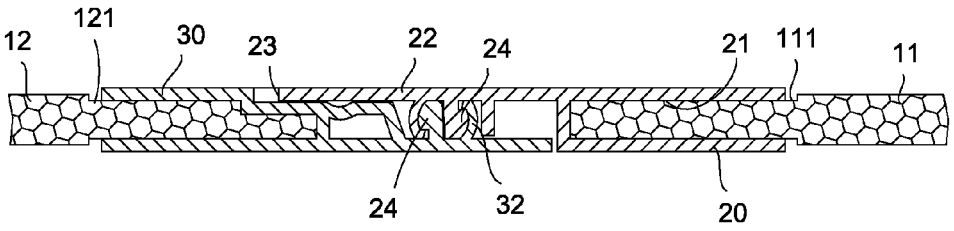
FIGS. 5 to 8 respectively are another cross-sectional view of a buckling auxiliary on the two sides of the box body according to the present invention
Figure 6:
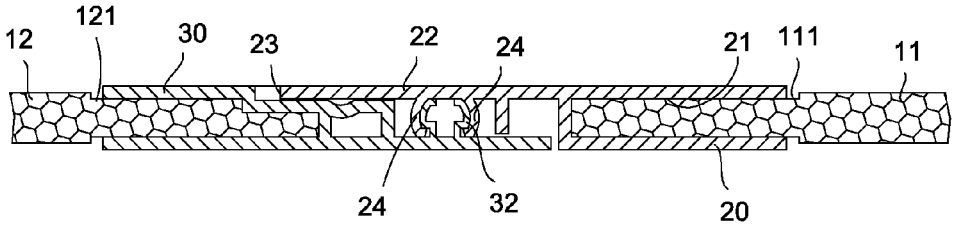
Figure 7:
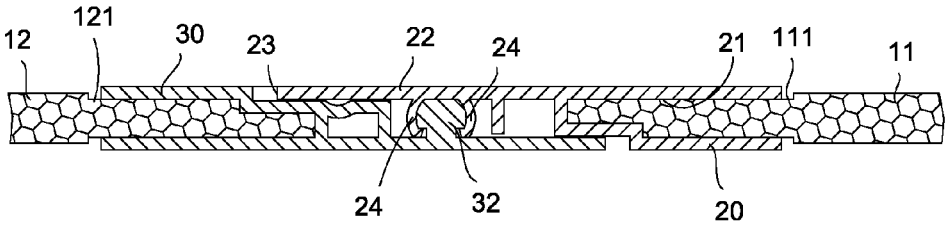
Figure 8:
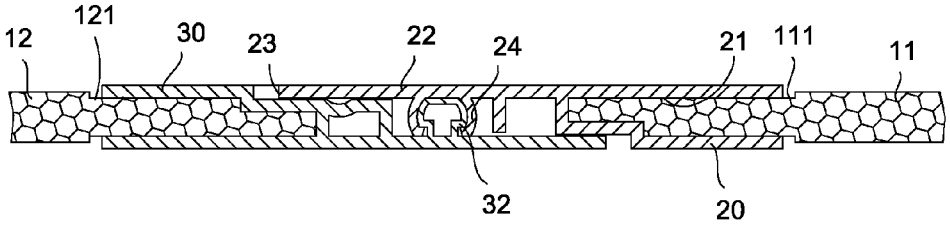

For forming convenience and practical buckling operation requirements, the shapes of male buckling element 24 and female buckling element 32 may be set to the ones of buckling elements shown in FIG. 5, which are close to the shapes mentioned above, being similar convex and half hook structures capable of engagement, buckling and positioning with each other. Upon unpacking, the tap 23 is poked and pulled upward to cause the male buckling element 24 to squeeze the female buckling element 32 away and to be separate from the buckling position so that the box can then be opened, allowing the articles inside to be taken out. In addition, the unpacked box body 10 can be recycled because of the features of a plastic box. Furthermore, referring to FIGS. 6 to 8, the configuration positions of the male, female buckling elements 24, 32 may be exchanged; the male buckling element 24 is a round rod approximately, and the female buckling element 32 is a corresponding mating groove. thereby buckling them together, where the rod can may be a solid, hollow or even open slot-typed body, allowing mating convenience and stability upon buckling; the male, female buckling elements may be arranged in a dot or separate column shape depending on a practical buckling length, all being capable of achieving similar buckling and positioning effects, sealing convenience and safety of the cover plate 11, 12; they all fall in the scope of the present invention, hereby declare.

I claim:

1. A sealing structure for a plastic packing box, comprising: a packing box body, made by bending a plastic plate; top and bottom openings; and cover plates, configured on sides of each opening and bended inward to stack together to seat said opening, wherein a premade mating frame is respectively engaged with sealing end faces of said cover plates configured on two opposite sides of said main body and bended to each other to form a sealing edge, said mating frames are a male-female pair stacked together to sealing said box, ensuring that two end faces is neat after box body sealing, the opposite inner edges of said two mating frames are respectively configured with male and female buckling elements allowed to be pressed together to engage with each other after said stacking, thereby achieving stable and safe buckling, while said cover plate are stacked together simply;

wherein each of the top and bottom openings has two opposite edges defining therebetween the opening and the cover plates are respectively corresponding to the opposite edges of the opening and are each in the form of a flap having a proximal edge connected to one of the two opposite edges of the opening corresponding thereto such that the flap is movable, through rotation about the connection between the proximal edge thereof and the corresponding edge of the opening, between an open position where a distal edge of the flap that is opposite to the proximal edge is moved away from the opening and a closed position where the distal edge of the flap seats in the opening such that the distal edges of the two flaps are adjacent to each other to close the opening;

wherein the two mating frames that are arranged in a male-female pair comprises a male mating frame and a female mating frame that are respectively mounted to the distal edges of the two flaps such that the male and female mating frames partly overlap and are thus jointed with each other to retain the two flap in the closed position to close the opening; and wherein the male and female buckling elements are respectively mounted to the male and female mating frames and are engageable with each other in the closed position so as to achieve jointing the male and female mating frames to each other to retain the two flaps in the closed position for closure of the opening.

2. The structure according to claim 1, wherein the flaps of said cover plates are each configured with two opposite surfaces and each of the two surfaces comprises a recessed mating face formed along the distal edge of the flap such that the two recessed mating faces of each of the flaps are opposite to each other and wherein the mating frames each comprises a groove defined and delimited by two opposite sidewalls, such that the distal edge of each of the flaps is received in the groove of the mating frame corresponding to the flap, allowing the sidewalls of the groove of the mating frame to be respectively positioned in the recessed mating faces to make the sidewalls substantially flush with opposite surfaces of the flap of said cover plate.

3. The structure according to claim 1, wherein said cover plate is stuck to said mating frame by means of hot welding.

4. The structure according to claim 1, wherein a buckling seat is mounted to and extends from two opposite ends of said male mating frame and is engageable with a groove buckling element configured on a side face of said box body when the flap to which the male mating frame is mounted is in the closed position.

5. The structure according to claim 1, wherein said male and female buckling element are convex half hook structures shaped correspondingly to each other.

6. The structure according to claim 1, wherein said male buckling element is a round rod, and said female buckling element is a corresponding mating groove adapted to be in engagement therewith.

7. The structure according to claim 6, wherein said rod is a solid, hollow or open notch-typed body.

8. The structure according to claim 1, wherein said male and female buckling elements are arranged in a dot or separate column according to a buckling length.

9. The structure according to claim 1, wherein said male, female buckling elements are positioned exchangeably.

* * * * *